United States Patent [19]

Knife

[11] 4,324,532

[45] Apr. 13, 1982

[54] CARTRIDGE PUMP

[75] Inventor: James E. Knife, Dayton, Ohio

[73] Assignee: TRW Inc., Cleveland, Ohio

[21] Appl. No.: 114,926

[22] Filed: Jan. 24, 1980

[51] Int. Cl.[3] ..... B67D 5/40; F04R 39/14

[52] U.S. Cl. ..... 417/360; 222/333; 222/385

[58] Field of Search ..... 417/360; 222/385, 333

[56] References Cited

U.S. PATENT DOCUMENTS

| | | | |
|---|---|---|---|
| 2,941,476 | 6/1960 | Pezzillo . | |
| 3,112,049 | 11/1963 | Messer | 222/385 X |
| 3,172,365 | 3/1965 | Nasuytis . | |
| 3,369,715 | 2/1968 | Carter | 222/385 X |
| 3,690,516 | 9/1972 | Sentarelli | 222/385 X |
| 3,743,447 | 7/1973 | Lynch | 417/360 |
| 3,890,065 | 6/1975 | Eller | 417/360 |
| 3,963,381 | 6/1976 | Kohner | 417/360 X |
| 3,973,868 | 8/1976 | Weisser | 417/360 X |
| 4,174,791 | 11/1979 | Auchter | 222/385 X |

FOREIGN PATENT DOCUMENTS

| | | | |
|---|---|---|---|
| 557524 | 11/1943 | United Kingdom . | |
| 878857 | 10/1961 | United Kingdom . | |
| 896994 | 5/1962 | United Kingdom . | |
| 940510 | 10/1963 | United Kingdom . | |
| 976638 | 12/1964 | United Kingdom | 417/360 |

OTHER PUBLICATIONS

Drawings 164A212, 165A212, Pump, Fuel, TRW, Globe Industries Div. Dayton, Ohio, 1975.

*Primary Examiner*—Richard E. Gluck
*Attorney, Agent, or Firm*—Biebel, French & Nauman

[57] ABSTRACT

A cartridge-type pump particularly adapted for aircraft or rotorcraft fuel systems incorporates a pump housing which is mounted in a wall of the fuel tank, which housing defines a cartridge pump cavity and a fuel inlet and a fuel outlet. A cartridge-type pump is received in the pump cavity with ports which communicate with the inlet and the outlet. The inlet is provided with an inlet valve which is normally biased to the closed position and is retained in the open position when the pump cartridge is seated in the pump housing so that upon removal of the cartridge, the inlet is automatically closed preventing loss of fuel from the tank. The cartridge is provided with a handle which, in a stored position, operates the inlet valve and which also serves to cam or lift the cartridge out of its seated position and which also operates to cam or force the cartridge into a seated position when the cartridge is being re-installed. The pump is further provided with a bleed valve through which air entrapped within the pump may be automatically purged and which provides for flow of fluid over the pump for the purpose of cooling the pump and lubricating the pump bearings.

7 Claims, 11 Drawing Figures

CARTRIDGE PUMP

BACKGROUND OF THE INVENTION

This invention relates to cartridge-type pumps and more particularly to a cartridge-type pump for use in avaiation fuel systems and the like, and more specifically for use on helicopters, aircraft, and other vehicles where it is desired to perform pump maintenance quickly and readily in the field without the necessity of disturbing the fuel fittings to the pump.

It has been common practice to provide an integral pump and housing for helicopter and aircraft fuel tanks, in which the pump housing is placed directly into an opening in the fuel tank for delivery of fuel under pressure to an aircraft engine. Specifically, helicopters have been provided with electrically driven fuel pump assemblies which mount in a lower wall of the tank and which receive the aircraft fuel, such as JP-4, for delivery under a positive head to pressure to the aircraft engine. When such pumps have required maintenance, it has been necessary to drain the tank of all fuel, to disconnect the fuel outlet connection from the pump and assembly, and to remove the entire assembly from the vehicle for service and replacement. This procedure has required the collection of aircraft fuel outside of the aircraft in suitable containers to prevent contamination of the surrounding area and has further required a substantial amount of down time for the aircraft or helicopter involved. In addition, since the fitting or connection from the pump to the fuel line had to be broken, it was necessary to reassembly these parts and remake such a connection with care to assure that the entire assembly was fluid tight and to assure that no leaks were present after the maintenance.

SUMMARY OF THE INVENTION

The present invention is directed to a fuel pump of the cartridge type specifically adapted for use in aviation related fuel systems in which a permanently mounted pump housing receives a readily removable and replaceable cartridge-type pump. The fuel housing itself is provided with a fuel inlet and a fuel outlet, neither of which is disturbed during the replacement of the pump cartridge. The fuel inlet in the housing is provided with a flow-control valve, and this valve is held and retained in a flow-open or flow-permitting position when the cartridge is seated, by means of a valve operating member associated with the cartridge itself. Removal of the cartridge results in the closing of the inlet valve so that the fuel remaining in the tank is sealed therein and cannot escape to the outside, thereby eliminating the necessity of draining the tank for the purpose of servicing the pump.

In the preferred embodiment of the invention, the cartridge is provided with a handle which is movable between a folded or flat storage position and a raised or lifted operating position. The handle is retained in its storage position by a fastener, and includes a portion which engages an operating member associated with the inlet valve and moves the inlet valve against a spring bias into its open or flow permitting position. The release of the handle from the storage position permits the inlet valve to be closed, thus sealing off the fuel within the tank from the pump cartridge.

The handle is further provided with a rearwardly extending cam portions which are adapted to engage the pump housing so that continued movement of the handle from its flat storage position to a raised or lifted position causes the cam portion to engage the housing and lift the pump cartridge from its seated position within the housing to assist in removing the cartridge. Preferably, the rearward extending portions of the handle are provided with a second cam means which engage housing portions during the reassembly of the pump cartridge within the housing so that return movement of the handle to its flat or storage position, causes the second cam means to engage housing portions and force the cartridge back into a relatively seated position.

The cartridge itself incorporates a housing which contains a drive motor and an impeller mounted within a suitable impeller housing defining fluid inlets and outlets communicating respectively with the inlet and outlet of the main housing. The electric pump motor in effect runs in a submerged condition within the protective housing, and the fluid being pumped serves both to cool the motor and as a lubricant for the motor bearings. The cartridge pump housing includes one way valve means through which a small quantity of the fluid being pumped may be discharged for the purpose of purging the interior cavities of any air, to permit priming of the pump, and at the same time, to provide a flow of fluid past the pump for cooling purposes. The one way valve means expells this small quantity of pump fluid into the interior of the tank.

It is accordingly an important object of this invention to provide an improved cartridge-type liquid pump which incorporates an automatically actuated cut-off valve which prevents flow of fluid from the tank when the cartridge is removed.

A further object of the invention is to provide an improved cartridge-type fuel pump for aircraft, such as helicopters, in which the cartridge element may be readily changed or removed for servicing and replaced by a serviceable unit with a minimum of down time for the aircraft involved.

A still further object of the invention is to provide a cartridge-type pump having an actuator handle, as outlined above, which assists in the dislodging and removable of the cartridge from its seated position.

A still further object of the invention is the provision of a cartridge-type pump, as outlined above, which incorporates a spring-biased inlet valve which is held in a normally open position but which is automatically closed upon the removal of the pump cartridge.

A still further object of the invention is the provision of a cartridge-type pump incorporating a purge valve by means of which air entrapped within the impeller cavity is automatically removed.

A still further object of the invention is the provision of a cartridge-type pump having a pump cartridge incorporating an operating handle which, in the stored position, holds an inlet valve open and which is further provided with an operating lever to aid in the removal of the cartridge from its seated position and further to aid in the seating of the cartridge upon return of the handle to its folded or stored position.

These and other objects and advantages of the invention will be apparent from the following description, the accompanying drawings, and the appended claims.

DESCRIPTION OF PREFERRED EMBODIMENT

Figure 1:
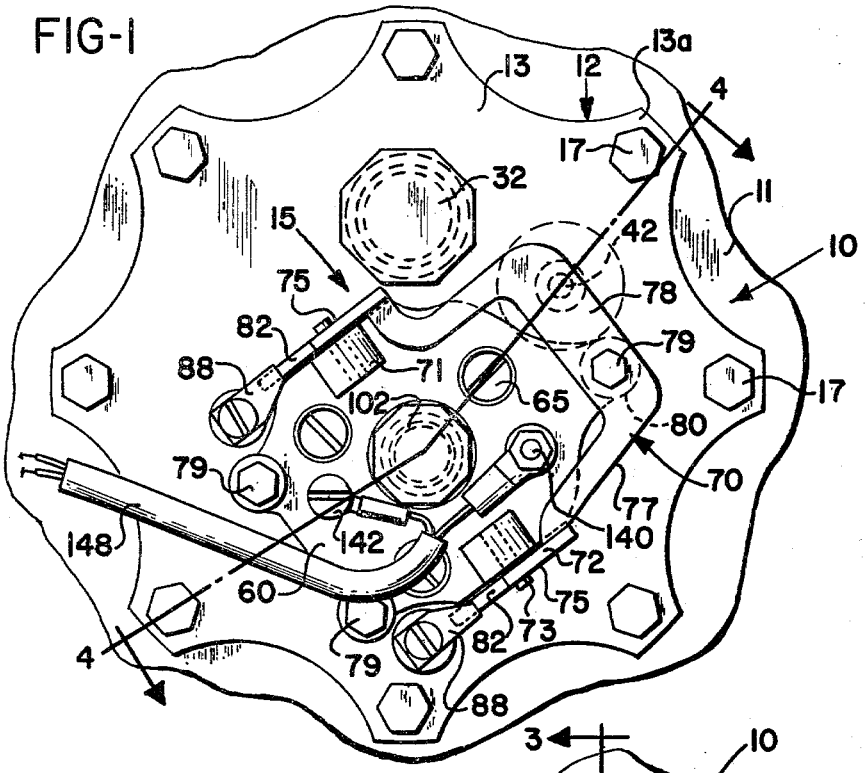
FIG. 1 is a top or outside plan view of the pump assembly of this invention shown as installed in a fuel tank.
Figure 2:
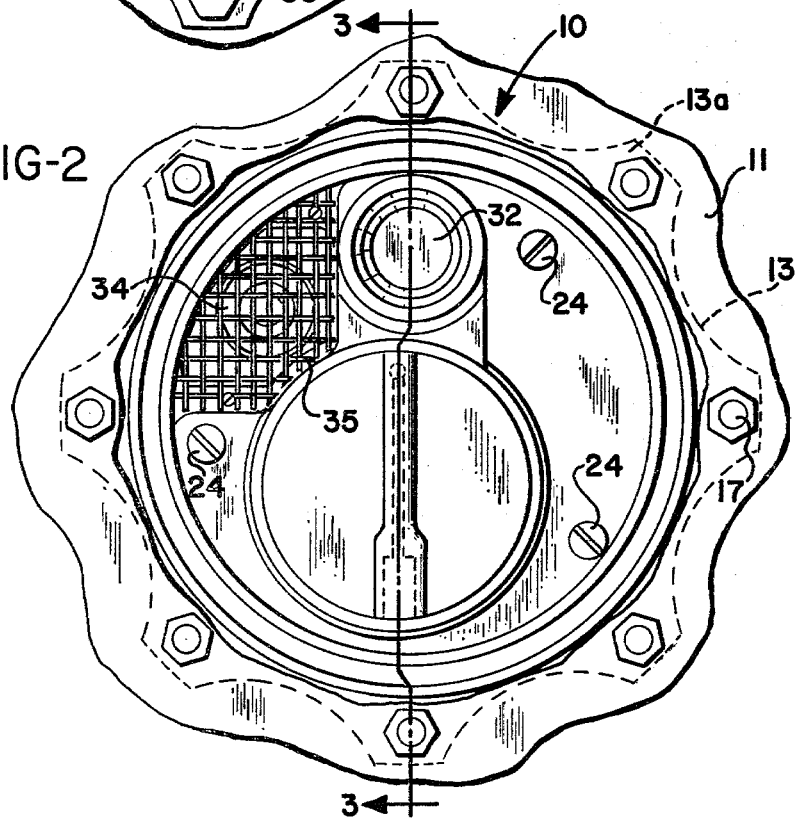
FIG. 2 is a bottom or inside view thereof, looking from inside the tank.

The pump assembly of the present invention is illustrated generally at 10 in FIGS. 1 and 2. The pump assembly is adapted to be mounted within an opening formed in the wall of an aviation-type fuel tank which wall fragment is illustrated by the reference number 11 of FIGS. 1 and 2. The tank wall 11 may be part of a helicopter fuel tank, but the invention is not intended to be limited to helicopter fuel tanks, and the same may be used generally in aviation-type tanks, or wherever it is desired to provide the capability of pumping fuel, or other liquid, and to provide for ready repair or interchange of a cartridge pump unit. The fuel pump assembly of the present invention comprises two major parts, a pump housing assembly 12, and a removable cartridge unit or pump cartridge 15, which is illustrated in elevational view in FIG. 8. The pump housing assembly 12 is, in turn, made up of three major components. The first of these is a cover or mounting plate 13 which is generally circular when viewed in plan, as shown in FIG. 1, and which is provided with a plurality of outwardly extending portions 13*a* through which mounting bolts 17 may be received for fastening the housing assembly 12 within a prepared opening or cut-out formed in the wall of the tank 11. As shown in section in FIG. 3 and in inside plan view in FIG. 2, the mounting plate 13 is provided with an annular, inwardly facing O-ring groove to receive an O-ring 18. The O-ring 18 forms a seal between the wall 11 of the tank and the cartridge pump housing. The cut-out which is formed in the wall 11 of the tank to receive the cartridge pump assembly 12 is preferably and normally positioned or formed in the bottom wall of the tank so that the cartridge pump of the invention is operated in an inverted position at or near the bottom of the tank, so that the major portion of the fuel in the tank may be received by the pump and removed therefrom. For example, such fuel may be JP-4 aviation fuel.

Figure 3:
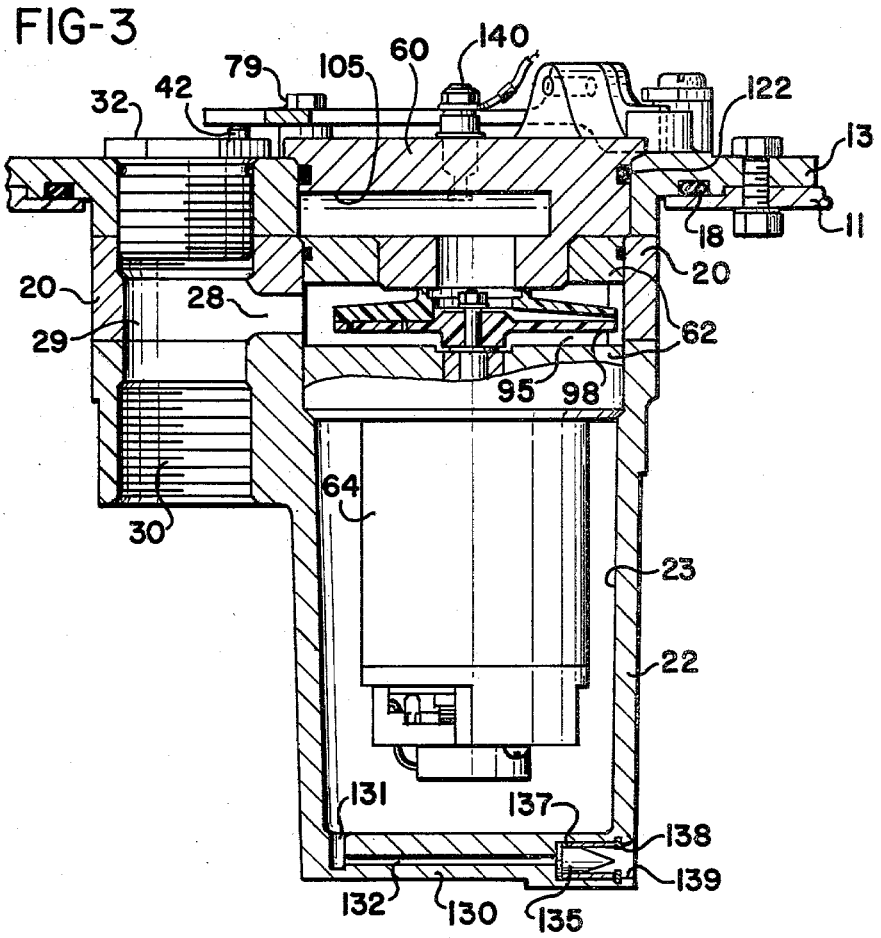
FIG. 3 is a vertical section through the pump assembly taken generally along the line 3—3 of FIG. 2.
Figure 4:
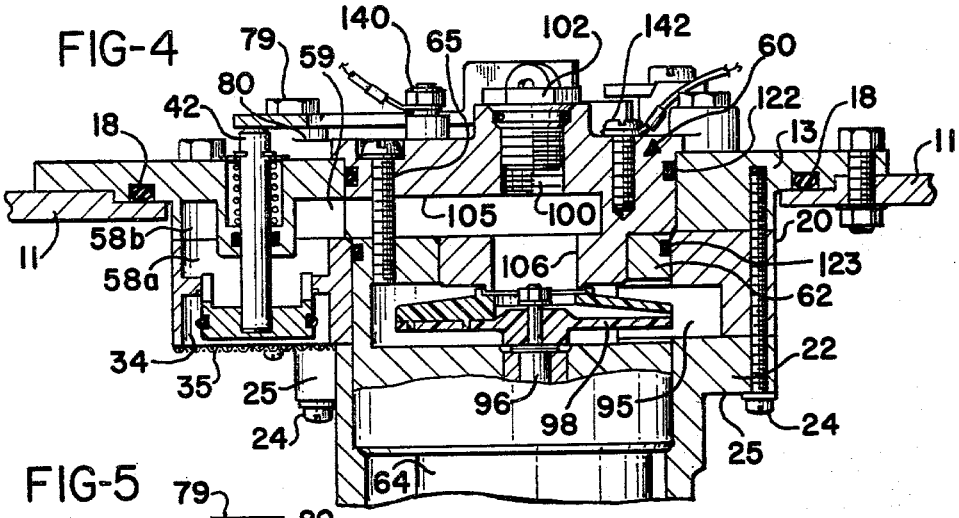
FIG. 4 is an enlarged fragmentary vertical section through the pump assembly taken generally along the line 4—4 of FIG. 1.

The three housing sections which make up the cartridge pump housing include the cover plate 13, an aligned intermediate housing section 20 and aligned inner housing section 22, as shown in sectional view on FIG. 3. The three housing sections, namely, 13, 20 and 22, define together an aligned generally axially inwardly extending opening or cavity 23 within which may be received the body of the cartridge pump unit 15. These three sections are retained together by fastener screws 24 as shown in FIGS. 2 and 4, extending outwardly from an annular ledge 25 formed on the inner housing section 22, through clearance holes formed in the inner section 22 and in the intermediate section 20, adjacent the outer walls thereof, into suitably tapped openings formed in the cover plate 13. A suitable sealant is preferably applied to the mating surfaces of the three housing sections making up the pump housing when these parts are assembled, and retained by the screws 24. It should also be noted that the axis defined by the pump or cartridge cavity 23 offset from the center of the bolt ring defined by the cover plate 13, for the purpose of providing space for the tie-bolts 24 and for providing space for the inlet and outlet ports formed in the pump housing.

Figure 5:
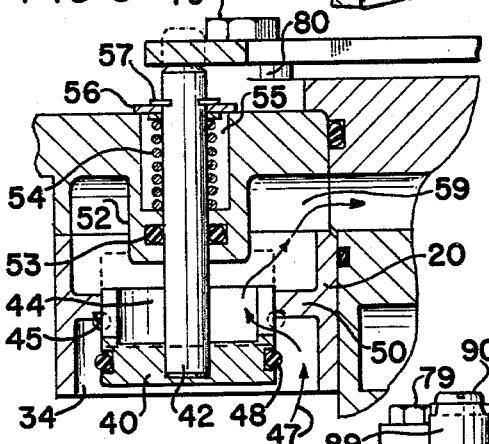
FIG. 5 is a fragmentary section showing the inlet valve portion of FIG. 4 on an enlarged scale.

The fuel inlet and outlet which are formed in the pump housing 12 are adapted to communicate with a corresponding inlet and outlet formed in the pump cartridge 15 when the cartridge is inserted within the pump housing 12. The arrangement of the inlet port of the pump housing is best shown in FIGS. 4 and 5, while the outlet porting arrangement is best shown in FIG. 3. It is convenient to describe the outlet port first as it is shown in section in FIG. 3. Thus, the intermediate section 20 is provided with a generally radially directed passageway 28 which opens through the side wall of the intermediate section into the internal cavity or axially opening formed therein, to receive the cartridge 15 and extends radially outwardly into a transverse or generally axially aligned outlet passage 29 which, in turn, communicates with a threaded aligned outlet 30 formed in the inner housing section 22. However, provision is made for the pump outlet to be taken externally of the tank, if desired, and for this purpose there is also provided in the mounting plate 13 a corresponding axially aligned opening, as shown in FIG. 3, normally closed by a closure plug 32. The outlet opening 30 is formed with internal threads for the purpose of receiving a conventional hose fitting for the removal of fluid under pressure from the pump assembly 12.

The inlet arrangement to the pump housing is best seen in FIGS. 4 and 5. For this purpose, the intermediate housing 20 is provided with an inlet port 34 which may be seen in FIGS. 2 and 4 as being covered and protected by an inlet screen 35.

An important feature of the invention is the incorporation of valve means in the pump housing at or associated with the inlet for the purpose of controlling the flow of liquid or fuel to be pumped to the pump cartridge and more particularly for the purpose of preventing the escape of fluid from the tank when the cartridge unit is removed, such as for servicing. Thus, the valve means includes a member which is movable between an open flow-permitting position and a closed flow-blocking position, and is automatically moved to the flow-blocking position whenever the pump cartridge 15 is removed. For this purpose, a generally sleeve-shaped or cup-shaped valve member 40 is mounted on an operator member or pin 42, and the pin slidably extends through an opening formed in the mounting plate 13 so that the top of the pin extends above the upper surface of the plate 13, as shown for example in FIGS. 4 and 5. The valve member 40 is formed with an outwardly extending skirt 44 and this skirt is formed with four arcuately spaced cut-out portions or openings 45 thereof through which the fluid to be pumped may freely move when the valve member 40 is in its open position. This movement of fluid is illustrated by the arrows 47 in FIG. 5. The inner or closed end of the valve member 40 supports on its outer surface thereof an O-ring 48 which engages an annular guide and shoulder 50, formed as part of the intermediate housing 20, when the valve member 40 moves to the closed position. This closed position is illustrated in FIG. 5 by the broken lines.

The valve operator pin 42 is guided within the mounting plate 13 for opening and closing movement by an inwardly extending boss or pin support 52, and is sealed by an O-ring 53 captured within an inwardly facing O-ring groove formed in the support 52. The valve member 40 is normally biased to a closed or flow-blocking position by a coil-spring 54 received about the shank of the pin 42 and within a cavity 55 formed in the outer surface of the plate by the boss 52. The outer end of the spring 54 bears upon a washer 56 held in place on the pin 42 by a snap ring 57, and the spring 54 urges the pin 42 and valve member 40 to the closed position. When the valve member 40 is opened, as shown in FIG. 5, the fluid flows through the slots 45 formed in the skirt 44, into cooperating inlet cavity portions **58*a* and 58*b* formed respectively in the mating pump housing sections 20 and 13. The outer cavity 58*b* also forms an inlet port 59 in a wall thereof which communicates with the inlet of the pump cartridge 15**.

As previously noted, pump cartridge 15 is provided with a body which is proportioned to be received within the axial cavity 23 of the pump housing 12. For this purpose, the body of the pump cartridge includes an outer end plate 60 which defines the pump inlet, an impeller housing 62 which is formed in mating relation to the end plate 60 and which, in turn, supports a drive motor 64. The end plate 60 is secured to the impeller housing 62 by three screws 65 which extend through the wall thereof from the outer surface of the end plate 60, as shown in FIGS. 1 and 4, and the drive motor 64 is mounted on an inner surface of the impeller housing 62.

The pump cartridge 15 includes means for engaging the pin 42 of the inlet valve member 40 to hold the valve member in the open position when the pump cartridge 15 is seated within the pump housing 12 and for providing for the closure of the valve member 40 by the spring 54 concurrently with the removal of the pump cartridge 15. For this purpose a valve operator means is associated with the cartridge 15 in the form of a generally bale-shaped handle 70, as best seen in FIG. 1. The handle 70 is pivotally mounted to the cover plate or end plate 60 of the cartridge 15 on raised bosses 71 and 72 integrally formed in the end plate 60 and which receive generally outwardly extending pins 73. The handle 70 has flat parallel side sections 75, which are pivotally received on the pins 73. The flat sections join with a generally U-shaped gripping section 77, which includes a transverse connecting portion 78. The handle 70 is movable on the pins 73 between a generally flat or storage position, as illustrated for example in the side view thereof in FIG. 6, to a raised or lifted position when the pump cartridge 15 is being removed or replaced, as shown in FIG. 7. In the flat or storage position, as illustrated in FIG. 1, and in FIGS. 3–6, the transverse connecting portion 78 of the handle 70 engages the outer exposed end of the pin 42, and retains the valve member 40 in the open position as shown in FIGS. 4 and 5.

When the pump cartridge 15 is assembled within the housing 12, the handle 70 is normally retained and held in its flat storage position, in contact and in engagement with the pin 42, by a retainer bolt 79 forming one of three such retainer bolts which extend through the cover plate 60 and hold the pump cartridge in its seated position. The flat position of the handle 70 is defined by an elevated, truncated boss 80, as seen in elevation in FIGS. 4 and 5, which engages the lower surface of the transverse handle section 78 and defines the folded position of the handle as one which holds the valve member in the opened position. When the retainer bolt 79 is removed and the handle 70 is lifted or raised as shown by the direction of the arrow 81 in FIG. 7, the valve member 40 is permitted to close under the influence of the spring 54 and thus seals off the inlet port 34 so that fuel within the tank cannot escape through the pump housing 12.

Figure 6:
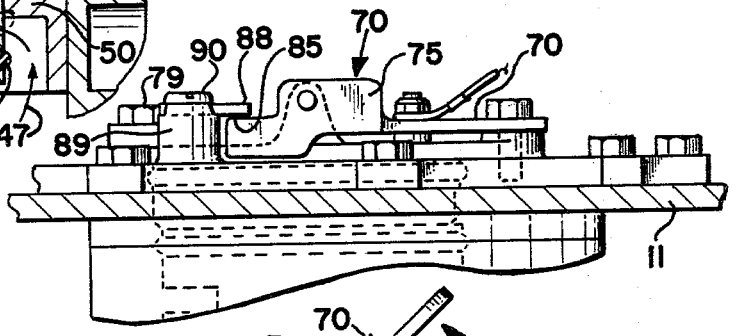
FIG. 6 is an enlarged fragmentary elevational view of the assembly showing the cartridge handle in the stored position.
Figure 7:
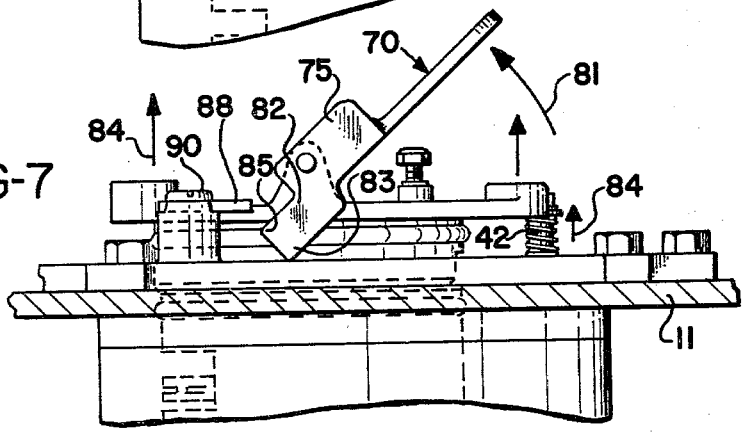
FIG. 7 is a view similar to FIG. 6 showing the manner in which the lever or heel portion of the handle serves to dislodge the pump cartridge when the handle is moved from its stored position to its raised position.

As best seen in FIGS. 6 and 7, the flat side sections 75 of the handle 70 are formed with rearwardly extending portions 82, that is, portions which extend rearwardly in relation to the pivot pins 73. The rearwardly extending portions 82 provide two distinct and important functions. The first function is that of camming the cartridge 15 out of its seated position, whenever the handle is grasped and lifted to a raised or partially raised position, as shown in FIG. 7. The first function of camming the cartridge 15 out of its seated position is accomplished by toe portions 83 formed on the extension portions 82 which, upon lifting movement of the handle 70 from its flat or storage position, engage the underlying outer surface of the mounting plate 13 and causes the pump cartrige to be initially cammed or lifted out of its seated and sealed position. This initial movement of the cartridge is illustrated by the arrows 84 in FIG. 7.

Each of the rearwardly extending portions 82 is also provided with an upper heel portion 85. The heel portion 85 has no function in removing the pump cartridge. However, when the cartridge is reinserted into the pump housing, the heel portions 85 are proportioned to engage tabs or stops 88 carried on raised bosses 89 formed on the outer surface of the plate 13 and retained by retainer screws 90. The reverse or lowering movement of the handle 70, in the direction opposite to that of the arrow 81 in FIG. 7, causes the heel portions 85 to engage the inside or lower surfaces of the tabs 88 and in effect assists in forcing the pump cartridge 15 inwardly into a sealed and seated position within the pump housing 12.

The pump cartridge includes an electric drive motor 64 of the permanent magnet submersible type which operates directly from a source of low-voltage DC power. The drive motor 64 is mounted to the annular impeller housing 62 and the latter is proportioned to form a reasonably close fit, together with the cover plate 60, into the cavity formed within the pump housing 12. The impeller housing 62 forms an integral impeller cavity 95, as seen in FIGS. 3 and 4, and the motor 64 has a shaft 96 which supports a plastic impeller 98 for rotation within the cavity 95.

Figure 8:
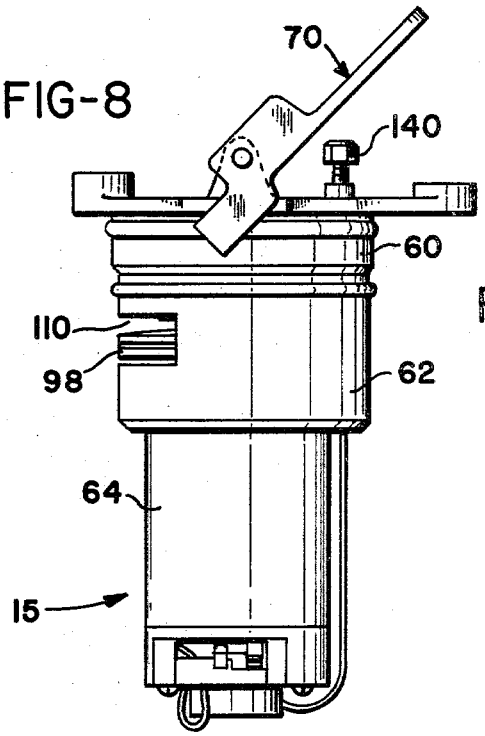
FIG. 8 is a side elevation of the pump cartridge removed from the pump housing.

The cartridge end plate 60 is formed with an axially extending, outwardly opening drain port 100 which port is normally closed by a closure plug 102. The drain port 100 opens into an inlet cut-out 105 which is formed in the inner surface of the end plate 60 and which has a radial end which communicates with the passageway 59 formed in the cover plate 13 of the housing 12, by means of which the fluid which flows through the valve 40 is admitted into the interior of the pump cartridge 15. Further, an axial passageway 106 is formed in alignment with the passageway 100 and terminates at an axial inlet formed within the impeller 98, the details of which are described in connection with FIGS. 10 and 11. The outlet from the cartridge pump unit is formed by the impeller housing 62 and this housing is provided with an arcuately cut-out portion 110, as seen in FIGS. 3 and 8 which opens from the impeller cavity 95 into the outlet port 28 formed in the intermediate housing section 20. The impeller 98 is positioned with its inlet in close running relation to the annular depending portion of the cover plate 60 which defines the axial inlet passage 106.

Figure 10:
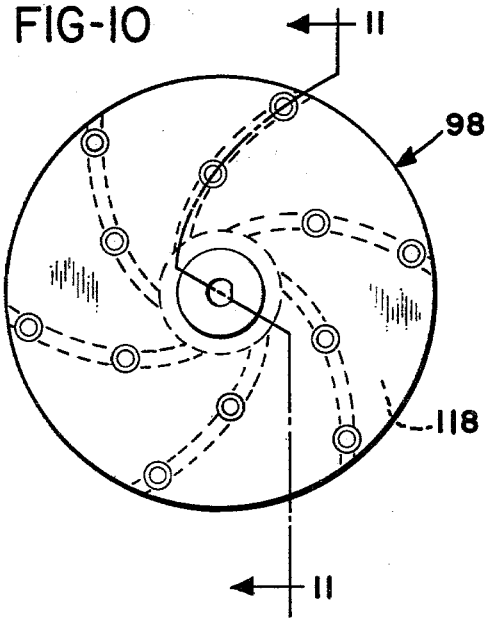
FIG. 10 is a plan view of the pump impeller.
Figure 11:
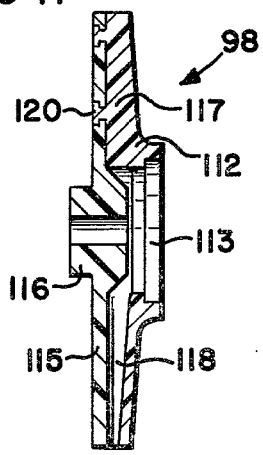
FIG. 11 is a section through the pump impeller taken generally along the line 11—11 of FIG. 10.

Reference may be had to FIGS. 10 and 11 showing the details of the construction of the impeller 98. Preferably, the impeller 98 is injection molded of a plastic material which is impervious to aircraft fuel, and may be formed from two parts which include an outer generally disc-shaped part 112 which defines the central impeller inlet 113, and a drive disc 115 which has a hub 116 adapted for mounting to the motor shaft 96. The outer impeller part 112 defines a series of outwardly curved vanes 117, as shown in broken outline form in FIG. 10 and in section in FIG. 11, which vanes define radially open passageways 118 therebetween, by means of which the fluid entering the inlet to the impeller is accelerated and discharged outwardly of the periphery and into the impeller cavity 95. The impeller parts 112 and 115 are bonded together into a unitary impeller structure by means of axial protuberances 120 on the vanes 117 which extend through apertures formed in the disc part 115, which are then ultrasonically welded in place.

The pump cartridge end plate 60 is peripherally sealed to the pump housing 12 at the cover plate 13 by an O-ring 122 carried by the end plate and in engagement with the axial opening defined in the plate 13, and thus prevents the escape of fluid at inlet pressure from the pump housing to the exterior. The impeller housing 62 is also sealed to the intermediate housing 20 by a second O-ring 123. However, the impeller housing 62 is proportioned so that its outer surface forms a clearance fit with the surrounding housing members axially inwardly of the O-ring 123, so as to permit a controlled flow or leakage of fluid under pressure from the impeller cavity 95 into the interior of the housing and into the space surrounding the drive motor 64.

The inner housing member 22 is formed with a closed inner end 130, as viewed in section in FIG. 3. The inner housing end is provided with a vertically drilled passageway 131 communicating with a generally horizontal passageway 132 leading to a one-way valve 135, by means of which fluid under pressure from the interior of the motor housing cavity may flow back into the fuel tank. The valve 135 may be a duck-bill elastomer valve, as is known in the art, retained by a retainer sleeve 137 and a snap-ring 138 within an enlarged end 139 forming a continuation of the passageway 132. However, any other suitable one-way check valve may be used for the valve 135, which opens under a relatively low differential pressure thereacross.

The provision of the leakage path between the impeller housing 62 and the adjacent inside wall of the inner housing section 22 of the pump housing, together with the employment of the one-way valve 135, provides means for purging the interior of the pump housing as well as the impeller cavity 95 of any air which may be entrapped therein when the pump cartridge 15 is first inserted into the pump cartridge housing. The elongated generally transverse passageway 132 formed in the end 130 forms a conventional flame quench passageway so that no spark or flame created within the motor cavity may reach the outside of the pump housing. Further, it is preferred to employ a DC motor 64 wherein the sleeve bearings are lubricated by the fluid being pumped, and the controlled leakage path described above assures a constant supply of fuel into the interior of the pump housing defined by the inner housing section 22 for the purpose of lubrication. Further the flow of fuel therethrough, at a rather slow and controlled rate, provides for cooling of the motor 64.

Figure 9:
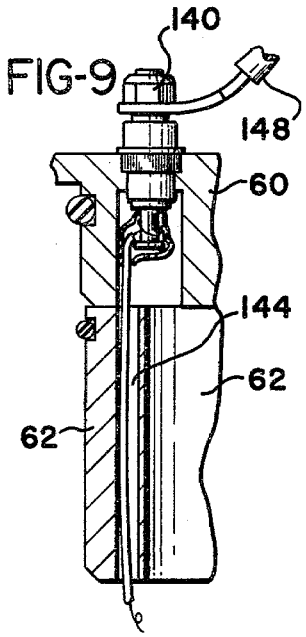
FIG. 9 is a fragmentary section through the pump cartridge showing the electrical power connection and lead-in for the pump motor.

The fragmentary sectional view of FIG. 9 shows the manner in which the electrical motor lead is brought through the impeller housing 62 to an insulated electrical terminal 140 mounted on the top of the end plate 60. Power to the motor is, on the one hand, brought to a grounded terminal retained by a retainer screw 142, shown in FIG. 1. The other lead is brought to the insulated terminal 140 and through a drilled axial passageway 144 formed in the wall of the impeller housing section from the brush end of the motor. The axis of the motor 64 itself is somewhat offset from the center line of the impeller housing 62, as shown in the bottom plan view of FIG. 2. This provides not only space for the inlets and outlets adjacent the motor, but also provides space for the motor wires to bypass the impeller cavity to a region at the outside of the pump cartridge where the power leads 148 may be connected.

The operation of the invention is largely self-evident from the foregoing description. The pump cartridge 15 may be readily removed for servicing by removing the several bolts 79 which permits the lifting of the handle 70 and results in the closure of the valve 40 under the influence of the spring 54, thereby sealing all of the fluid within the tank and preventing flow to the outside when the cartridge is removed. Further movement of the handle in the direction of the arrow 81 causes the toe 83 to engage the underlying outer surface of the top plate 13 and to cam the cartridge out of its seated position so that it may be readily removed. Thus, the cartridge may be removed without disturbing any of the fluid-tight fittings to the pump assembly.

The cartridge may be reinserted merely by pressing in place with the handle raised to bring the heels 85 in underlying relation to the plates 88, and thereafter the handle is pressed to its stored or flat position in which the heels rise against the underlying surfaces of the plates 88 and force the cartridge to a nearly seated position. The reinsertion of the three screws 79 completes the assembly process, and when the transverse portion 78 of the handle is brought back into place, it engages the pin 42 moving it from the broken line position to the full line position as shown in FIG. 5, thereby opening the inlet valve. Any air which has been entrapped either within the pump housing or the pump cavity is removed by flow past the cartridge into the interior of the pump housing and through the passageways 131 and 132 through the one-way valve 135.

While the form of apparatus herein described constitutes a preferred embodiment of this invention, it is to be understood that the invention is not limited to this precise form of apparatus, and that changes may be made therein without departing from the scope of the invention.

What is claimed is:

1. A cartridge pump assembly in which a pump housing is positioned within a tank of liquid to be pumped and a motor-driven cartridge pump unit is removably received in said pump housing, the improvement comprising:

means in said pump housing defining an inlet and an outlet, cooperating inlet and discharge ports formed in said cartridge pump unit opening into said housing inlet and outlet, valve means in said pump housing at said inlet movable between open and closed positions to permit flow of liquid to be pumped to flow through said inlet to the corresponding inlet port of the cartridge pump unit, valve operator means on said housing for moving said valve means from said closed to said open position, a bale-type handle on said cartridge pump unit for lifting said cartridge pump unit out of its seated position within said housing, said handle movable between a raised lifting position and a lowered storage position, and said valve operator means being engaged by said handle only in said storage position to open said valve means.

2. The assembly of claim 1 further comprising cam means on said handle operative when said handle is moved from its storage position to said lifting position to dislodge said cartridge pump unit from its seated position in said pump housing.

3. The assembly of claim 1 further comprising means biasing said valve means to said closed position whereby the movement of said handle from said stored position to said lifting position results in the closing of said valve means.

4. A cartridge-type pump assembly, comprising:

a housing, means mounting said housing on a tank, means on said housing defining an inlet and an outlet and a generally axial cavity extending into said tank, the cartridge type pump received in said cavity and having ports communicating with said inlet and with said outlet, means in said housing defining a valve in said inlet movable between an open position permitting flow into said cartridge pump and a closed position, valve operator means on said pump engaging said valve and holding said valve open in the seated position of said pump, and operable upon removal of said pump to close said valve, and handle means on said cartridge pump movable between a raised operative position and a flat stored position, and said valve operator means including a portion of said handle means engaging said valve in the stored position of said handle means for opening said valve.

5. The assembly of claim 4 further comprising cam means on said handle means engageable with said pump housing upon movement of said handle means from its stored position to its operative position for camming said cartridge pump out of seated position with respect to said housing.

6. The assembly of claim 5 further comprising cam means on said handle means engageable with said housing during movement into said storage position for urging said cartridge pump into a seated position.

7. A cartridge pump for aircraft fuel systems comprising:

a pump housing adapted to be mounted in the wall of an aircraft fuel tank and having means defining an inlet and an outlet, means in said housing defining a generally inwardly extending cavity, opening into said housing inlet and outlet, a pump cartridge adapted to be sealably received in said housing at said housing cavity having a drive motor, an impeller cavity housing, means in said impeller cavity housing having an inlet communicating with said pump housing inlet and an outlet communicating with said pump housing outlet and further having an impeller in said impeller cavity housing connected to be driven by said drive motor, valve means in said pump housing in said inlet thereof movable between a flow-permitting and flow-blocking position, operator means on said cartridge engageable with said valve means for moving said valve means from said flow blocking position to said flow permitting position upon the installation of said cartridge and said pump housing cavity, spring means moving said valve means to said flow-blocking position upon removal of said cartridge from said pump housing cavity, and operator means on said cartridge having a bale-shaped handle pivotally mounted on said cartridge between a folded positon and a raised position and having a portion thereof engageable with said valve means in said folded position for opening said valve means.

* * * * *